United States Patent [19]

Dellacha

[11] 4,365,931

[45] Dec. 28, 1982

[54] FLUID DISPLACEMENT DEVICE

[76] Inventor: Jorge P. M. Dellacha, Cramer 4538, Buenos Aires, Argentina

[21] Appl. No.: 169,344

[22] Filed: Jul. 16, 1980

[51] Int. Cl.[3] ..... F01B 1/36

[52] U.S. Cl. ..... 415/90; 416/186 R

[58] Field of Search ..... 415/76, 90, DIG. 4; 416/179, 186 R

[56] References Cited

U.S. PATENT DOCUMENTS

| | | | |
|---|---|---|---|
| 2,087,834 | 7/1937 | Brown et al. | 415/90 |
| 3,864,055 | 2/1975 | Kletschaka et al. | 416/186 |
| 3,957,389 | 5/1976 | Rafferty et al. | 415/90 |

FOREIGN PATENT DOCUMENTS

| | | | |
|---|---|---|---|
| 599519 | 10/1932 | Fed. Rep. of Germany | 415/90 |

*Primary Examiner*—Louis J. Casaregola

*Attorney, Agent, or Firm*—Allison C. Collard; Thomas M. Galgano

[57] ABSTRACT

A new device for the displacement of fluids, has at least one essentially revolving covering, which has the form of a trunk of a cone or pyramid, which minor base has an inlet or catch-basin inlet for fluids. The revolving covering contains a core which is concentric therewith, and which has a surface of revolution non-parallel to the wall of the covering and which converges progressively towards the same so as to define therebetween an annular conduit that gets gradually narrower towards the major base of the above-mentioned revolving convering, which base forms an annular outlet or discharge socket for the fluid.

6 Claims, 6 Drawing Figures

FIG. 5
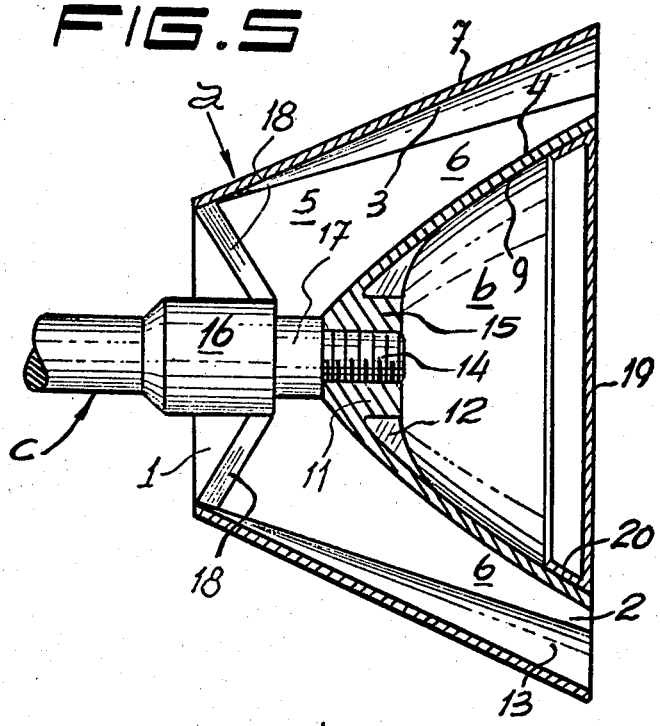
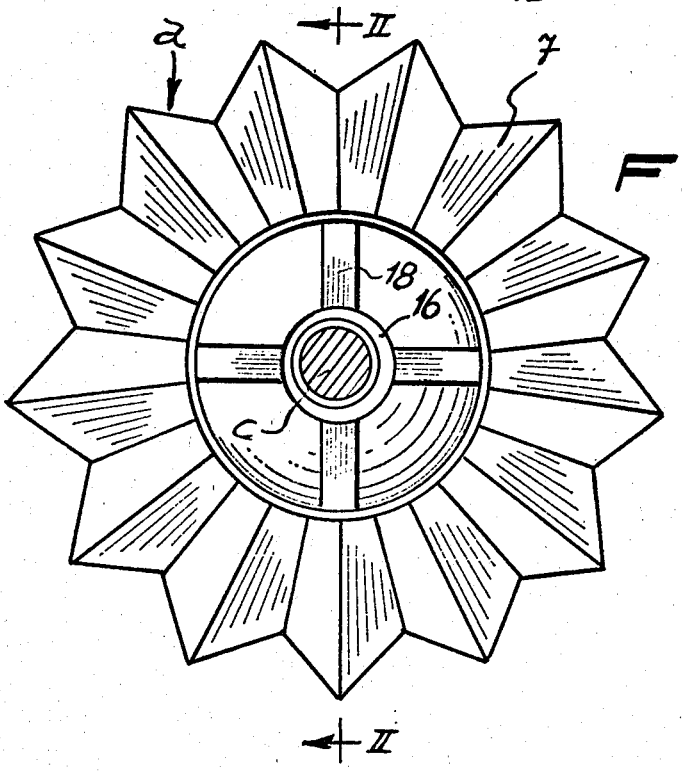
FIG. 6

FLUID DISPLACEMENT DEVICE

The present invention relates to a device for moving fluids. More particularly, the present invention especially deals with a new, simple and very useful revolving device which, by its unique construction, enables the fulfillment of different and important functions in all areas in which the movement and/or displacement of fluids may be necessary.

The on-going technological advancements in all fields, seek, of course, to achieve the development of new devices which are simpler in construction or which permit a greater functional efficiency. These advancements have also been made in the particular field of removal, movement, circulation or displacement of fluids, for various purposes; but curiously, such developments have always been based on rigid accepted principles, which logically have produced limitations, that up to now, have not been removed or eliminated. Thus, for example, when dealing with centrifugal mechanisms, turbines or centrifugal pumps pertaining to the movement of liquids, air or gas, efficient and interesting results were achieved, always on the basis of a device having a rotor with blades or the like, and a casing which, in many cases, includes static elements which cooperate with said rotor, and which generally afford a construction with the same or greater difficulties than the rotor itself.

Several studies and prior art attempts showed that except for some greater or lesser constructional modifications on the abovementioned basis structure, the problems as to the difficulty of fabrication and the great precision and the high costs of producing the existing rotors and their casings, have not been solved. This is because no one foresaw the possibility of conferring on the rotor itself characteristics which would enable it to perform a centrifugal action, and, principally, which would help to eliminate totally the expensive and complicated systems of blades and the like.

Accordingly, it is an object of the present invention to enable the production of a new, simple and highly efficient revolving device, which can generate by its own motion, the required centriugal action and which eliminates the abovementioned complicated blade systems.

It is a further object of the present invention to provide such a device which also simplifies the respective housing or casing and which affords the possibility of using such a device without the addition or cooperation of the housing or casing.

These and other related objects of the present invention are achieved by the provision of a new device bound to the movement of a liquid, which has at least one covering essentially rotatory which has the form of a cone or of a pyramid, which minor base is a catch-basin inlet of fluids. This revolving covering encloses a concentric core, which has a turning surface disposed in a non-parallel manner with respect to the wall of the covering and which converges progressively towards the same so as to define an annular tapering channel which gets gradually narrower towards the bigger base of the mentioned revolving covering, which base forms an annular discharge outlet for the fluid.

Other objects and features of the present invention will become apparent from the following detailed description when taken in connection with the accompanying drawings which disclose several embodiments of the invention. It is to be understood that the drawings are designed for the purpose of illustration only, and are not intended as a definition of the limits of the invention.

In the drawings, wherein similar reference characters denote similar elements throughout the several views:

FIG. 5 is another longitudinal sectional view taken along line II—II of FIG. 6, showing another practical embodiment of the invention; and FIG. 6 is a front, elevational view of the device shown in FIG. 5.

Figure 1:
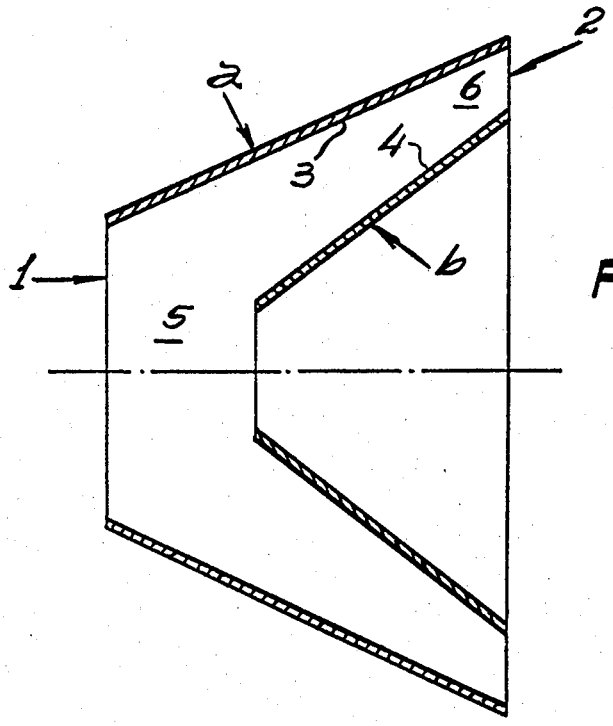
FIG. 1 is a schematic sectional view of a device emboyding the present invention.

Turning now in detail to the drawings, a device for moving fluids according to the present invention is shown which basically comprises a rotatable covering or housing, generally indicated by reference letter a; which has the form of a trunk of a cone or pyramid and whose minor base is a catch-basin fluid inlet 1. Revolving housing a encloses a concentric core, generally designated by reference letter b, which has a turning surface 4 disposed in a non-parallel manner relative to the wall 3 of the housing a and which converges progressively towards the same so as to define an annular tapering channel 6 that gets gradually narower towards the bigger base of the mentioned revolving covering a, which base forms an annular fluid discharge outlet 2.

FIG. 1 of the appended drawings clearly represents the principle on which the created new element is based. When the covering is set in motion in a revolving manner according to a regime of revolutions previously established, the fluid to be moved goes into covering a via inlet 1; the part of the covering right beside said inlet may be free to define an admission chamber 5. Due to the form of covering a, its quick rotation induces in the fluid a centrifugal action, which ends calmly around the inner core b, which is the narrowing factor of chamber 5 and which transforms the same into the annular chamber 6 which gradually tapers and ends in outlet 2. Due to the gradual narrowing of chamber 6, and to the centrifugal action produced by the rotation of covering a, the fluid, as a consequence, increases its pressure and speed when it goes through the annular passage 6 and outlet 2.

Figure 2:
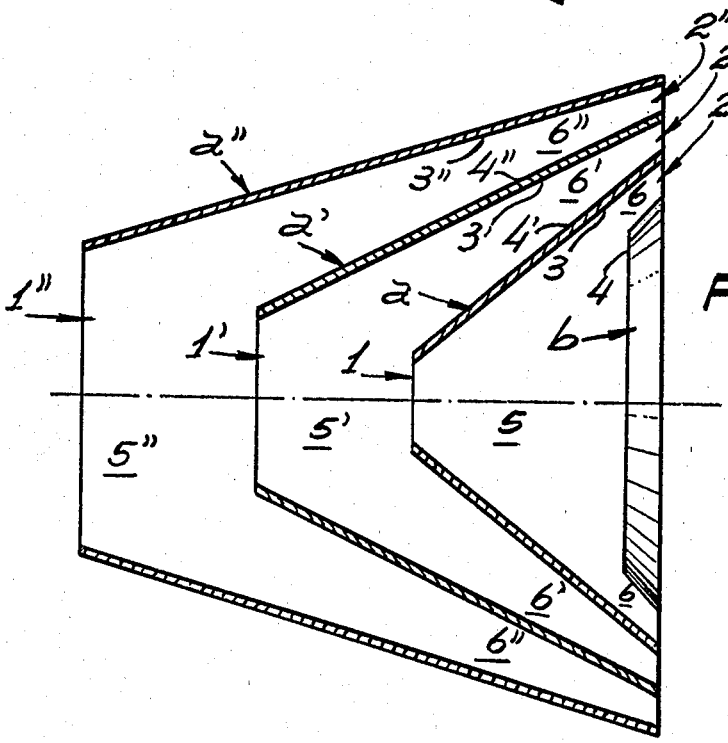
FIG. 2 is a schematic sectional view showing an alternate embodiment of the device.

Several variations may be made to the basic construction shown in FIG. 1, such as the one shown in FIG. 2. In this particular case, instead of only one revolving covering a, many of them are incorporated—three, according to the example—generally designated by reference letters, a, a' and a'', which are placed concentrically and are rigidly united with each other by the use of appropriate means (not shown) so that they all rotate together.

In FIG.2, one can clearly see that each one of the coverings a, a' and a'' has a conicity or wall inclination different from the others. The revolution surface inclination of core 4 may also be different, the latter being represented preferably but not necessarily by a disk-like member.

According to the aforementioned disposition, the minor bases and each of the respective continuous zones of the three coverings a, a' and a'' form the inlets 1, 1' and 1″, and the corresponding admission chambers 5, 5′ and 5″. Moreover, the inclination differences which exist between the surfaces 3–4, 3′–4′ and 3″–4″ cause the formation of the respective annular tapering passages 6, 6′ and 6″ each of them ending in annular discharge outlets 2, 2′ and 2″, respectively.

Not only in the case where the device is provided with only one covering a (FIG. 1) but also where it includes several of them (FIG. 2) the essential condition is for them to always be revolving; on the other hand, the inner core b may be revolving or fixed, according to the invention's own practical application. In the first case, said core may be firmly linked to covering a forming only one revolving member, or may include its own axle for mounting which will be independent from the axle that carries covering a. However, the sense and speed of rotation of said axles must be the same.

FIGS. 3 to 6 represent two possible ways of producing this device in which covering a and core b are only one revolving unit. According to FIGS. 3 and 4, body 7 of covering a has firmly fixed in its inside, with the aid of a set of radial supports 8, a cone 9 whose wall shows a certain convexity and which is coaxial relative to body 7. Cone 9 has an upper part 10 directed towards and disposed near inlet 1.

Cone 9 is provided on its rear side with an axial projection 11, which is complemented with radial reinforcements 12, which permits the fixing or coupling of the respective end of an axle c of suitable construction to the revolving device. The axle is, in turn, connected to a drive member (not shown) to effect rotation thereof.

Although in the tests performed with an experimental model of this new revolving device for the movement of fluids, the necessary centrifugal action was attained even though the inner surface of covering a was smooth, an interesting improvement of that action was noticed, when the outlet surface was endowed with fluting, ribs, or the like, spread out longitudinally; one possible way of making such components may be the formation in the covering of a series of folds which form alternately opposed channel folds 13–13′, which, starting from a spot "zero" corresponding to the edge of inlet 1, get gradually deeper towards outlet 2. At this point, their profile is the same as the one which is clearly represented in FIG. 4.

Figure 3:
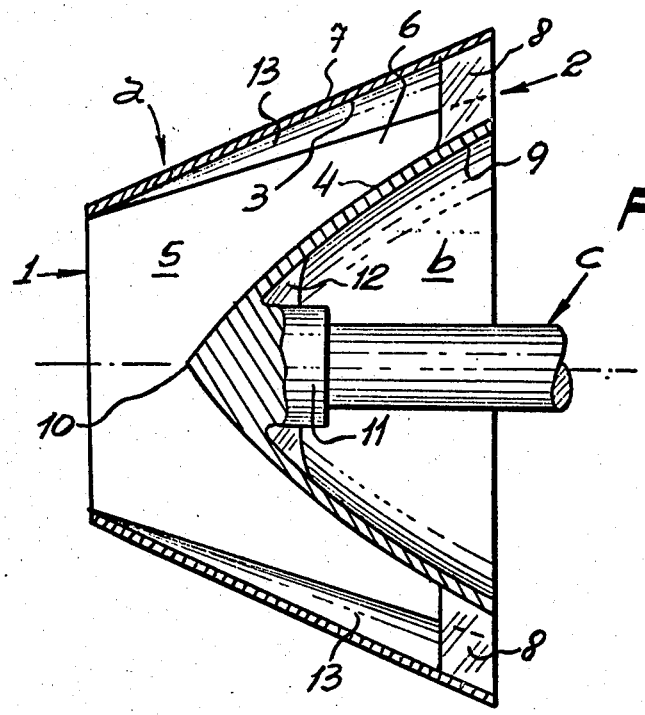
FIG. 3 is a longitudinal sectional view taken along line I—I of FIG. 4, showing a practical embodiment of the device according to the present invention.
Figure 4:
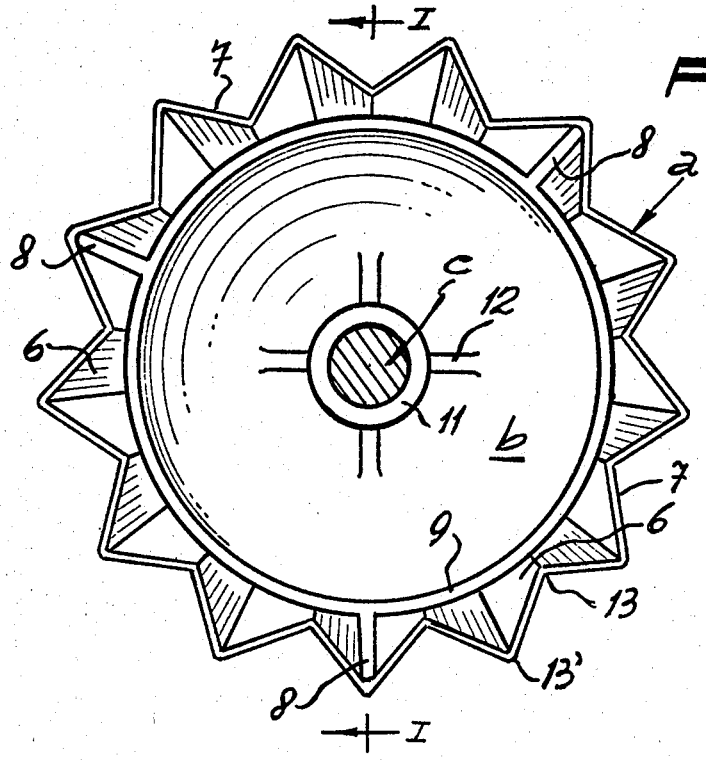
FIG. 4 is a rear elevational view of the device shown in FIG. 3.

FIGS. 5 and 6 show another variant of making the device in which the disposition of the members a–b is similar to the one of FIGS. 3 and 4, the only difference being the manner of union of said members and the disposition of the axle c. In this particular case, there is disposed axially in the inlet 1, with the help of a set of radial supports similar to those indicated in 18, an axial support extension member, or the like, 16 of a convenient kind and disposition, to which the abovementioned axle c is duly fixed; the extension member has an inner elongated portion 17 which ends in a threaded end 14 to which is attached the slightly truncated upper part of the inner cone 9, by means of an internally threaded part 15. As a result, the trunk of cone or pyramid a and the inner core b are strongly united to each other, forming a single structure which rotates together with the previously mentioned axle c. It is also interesting to note that, in this example, the base of cone 9 is closed by a disc 19 which has a peripheral connecting flange 20.

In consideration of the foregoing, it will be easily understood by those skilled in the art that the fundamental aspect on which the present invention is based is the fact of using as an essential component a covering which may have a truncated conical, truncated pyramidal, or the like configuration, having a revolving movement. On account of the covering's rotation in adequate revolutions the fluid which goes into it is forced to move, by means of a centrifugal effect, against the inner surface of the revolving covering. This initiates a compression which increases from the virtual covering axle towards the mentioned inner surface of the same; this practically radial movement is divided into movements almost parallel to the surface or to the virtual axle, and as a consequence, the fluid is drawn to the discharge outlet.

The complementary presence of the inner core has, as its object, to increase the compression and speed of exit of the fluid in relation with the gradual tapering formed between the surface of the core and that of the revolving covering.

The great possibilities of practical application of the new created element are also evident, which may be either for movement, transfer, displacement, etc. of fluids in fixed installments, or for the use of them as impulsing factors in case such an element is used as a propelling agent for movable objects.

Thus, while only several embodiments of the present invention have been shown and described, it will be obvious that many changes and modifications may be made thereunto, without departing from the spirit and scope of the invention.

What is claimed is:

1. A device for moving fluids comprising:

at least one rotatable covering defined by a tubular wall having a truncated configuration which has a minor base which defines a fluid inlet and a major base which at least partially defines a fluid outlet, said covering being provided with longitudinally-extending channel-forming ribs which begin at said inlet, get gradually deeper and end at said outlet; and a core which is concentrically disposed relative to the axis of rotation of said covering and which has a surface of revolution which is disposed in a non-parallel manner to the wall of said covering and which converges progressively towards the same so as to define therebetween an annular channel tapering in a direction towards said major base of said covering, the latter of which in cooperation with said core defines said fluid outlet.

2. The device according to claim 1, wherein a plurality of said rotatable coverings are provided and are concentrically disposed in an overlapping fashion with the innermost one at least partially enclosing said core, said coverings each having a differently angled revolution surface.

3. The device according to claims 1 or 2, wherein said core is independently and rotatably mounted relative to said covering which encloses it.

4. The device according to claims 1 or 2, wherein said core is rigidly fixed to said covering which encloses it.

5. The device according to claim 1, wherein said wall has a truncated conical configuration.

6. The device according to claim 1, wherein said wall has a truncated pyramidal configuration.

* * * * *